US005645038A

United States Patent [19]

Luk

[11] Patent Number: 5,645,038

[45] Date of Patent: Jul. 8, 1997

[54] TOY DART AND TOY GUN FOR LAUNCHING THE SAME

[75] Inventor: Ka Shiu Luk, Shatin, Hong Kong

[73] Assignee: Heep Tung Manufactory Limited, Hong Kong, Hong Kong

[21] Appl. No.: 626,485

[22] Filed: Apr. 2, 1996

[51] Int. Cl.[6] ..... F41B 11/14

[52] U.S. Cl. ..... 124/67; 124/84

[58] Field of Search ..... 124/65, 66, 67, 124/83, 84; 273/416, 419, 420, 423

[56] References Cited

U.S. PATENT DOCUMENTS

| | | | |
|---|---|---|---|
| 2,976,644 | 3/1961 | Crisci | 273/420 X |
| 3,021,640 | 2/1962 | Moore | 273/416 X |
| 3,859,977 | 1/1975 | Lange | 273/416 X |
| 3,968,784 | 7/1976 | Miller | 273/416 X |
| 4,212,285 | 7/1980 | Cagan et al. | 124/67 |
| 4,848,307 | 7/1989 | Tsao | 124/67 X |
| 5,058,561 | 10/1991 | Starr | 124/65 |
| 5,224,464 | 7/1993 | Burnham et al. | 124/67 |
| 5,522,374 | 6/1996 | Clayton | 124/67 X |

*Primary Examiner*—John A. Ricci

*Attorney, Agent, or Firm*—Samuels, Gauthier, Stevens & Reppert

[57] ABSTRACT

The invention provides a toy dart having a elongate body which comprises a front end in the form of a suction cup, an intermediate portion and a tubular rear end which is hollow and of an enlarged cross-section and preferably also a heavier weight. The invention also provides a toy gun for launching this toy dart, which comprises a body and an air pressurising mechanism provided by a piston and a cylinder inside the body for launching the toy dart. The cylinder has a tubular opening end over and around which the hollow rear end of the toy dart is to be fitted for launching. More specifically, the tubular end is provided by a tube which is removable to reveal another opening of the cylinder for the insertion of a conventional suction-cup toy dart having a plain shaft to be hit at a rear end by the piston.

5 Claims, 3 Drawing Sheets

TOY DART AND TOY GUN FOR LAUNCHING THE SAME

The present invention relates to a toy dart and a toy gun for launching said dart.

BACKGROUND OF THE INVENTION

Suction-cup toy darts are generally known, which usually have a front end in the form of a suction cup and a shaft extending rearwards. The shaft is plain, namely having a generally uniform cross-sectional size. A conventional toy gun for launching such a dart has a hollow barrel for receiving the dart by the shaft, in which a spring-loaded piston-and-cylinder mechanism is provided for, upon trigger release, compressing air inside the cylinder to project the dart forwards.

The invention seeks to provide an improved toy dart and a toy gun for launching such a dart.

SUMMARY OF THE INVENTION

According to a first aspect of the invention, there is provided a toy dart having a elongate body comprising a front end in the form of a suction cup, an intermediate portion and a rear end which is hollow and of an enlarged cross-section.

In a preferred embodiment, the rear end has a weight relatively heavier than that of the intermediate portion.

It is preferred that the rear end is substantially tubular.

Preferably, the intermediate portion has a substantially X-shaped cross-section.

The toy dart may preferably be integrally formed of rubber or soft plastic material.

According to a second aspect of the invention, there is provided a toy Sun for launching the aforesaid toy dart, which toy gun comprises a body and an air compression mechanism provided by a piston and a cylinder inside the body for launching said toy dart, said cylinder having a tubular opening end over and around which the hollow rear end of said toy dart is to be fitted for launching.

Preferably, the tubular end is removable to reveal another opening of the cylinder for the insertion of the hollow end of a said toy dart.

More preferably, the tubular end is provided by a tube having opposite ends of different diameters.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
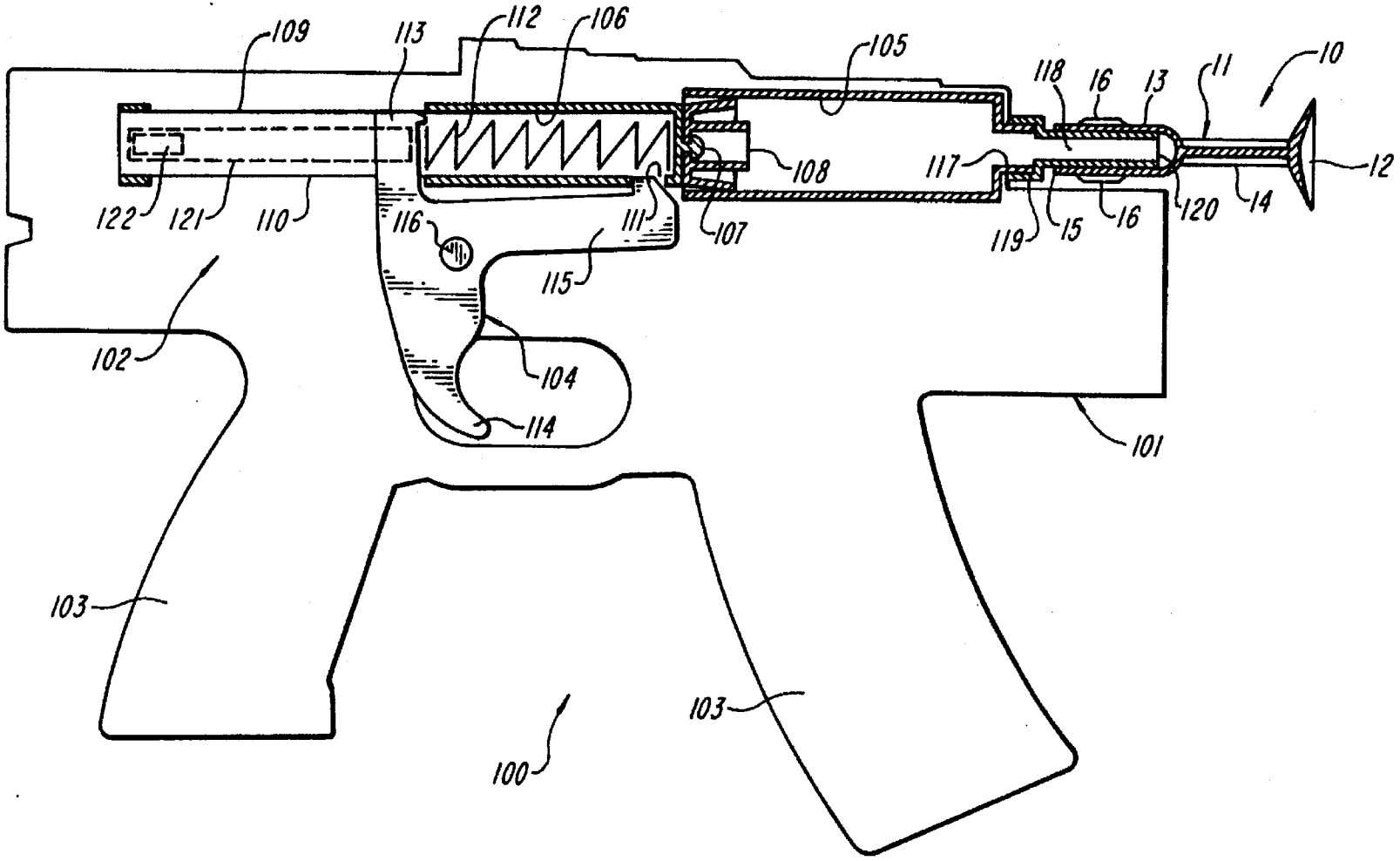
FIG. 1 is a cross-sectional side view of embodiments of a toy dart and a toy gun for launching the dart, in accordance with the invention, said toy gun being in a spring-loaded condition.
Figure 2:
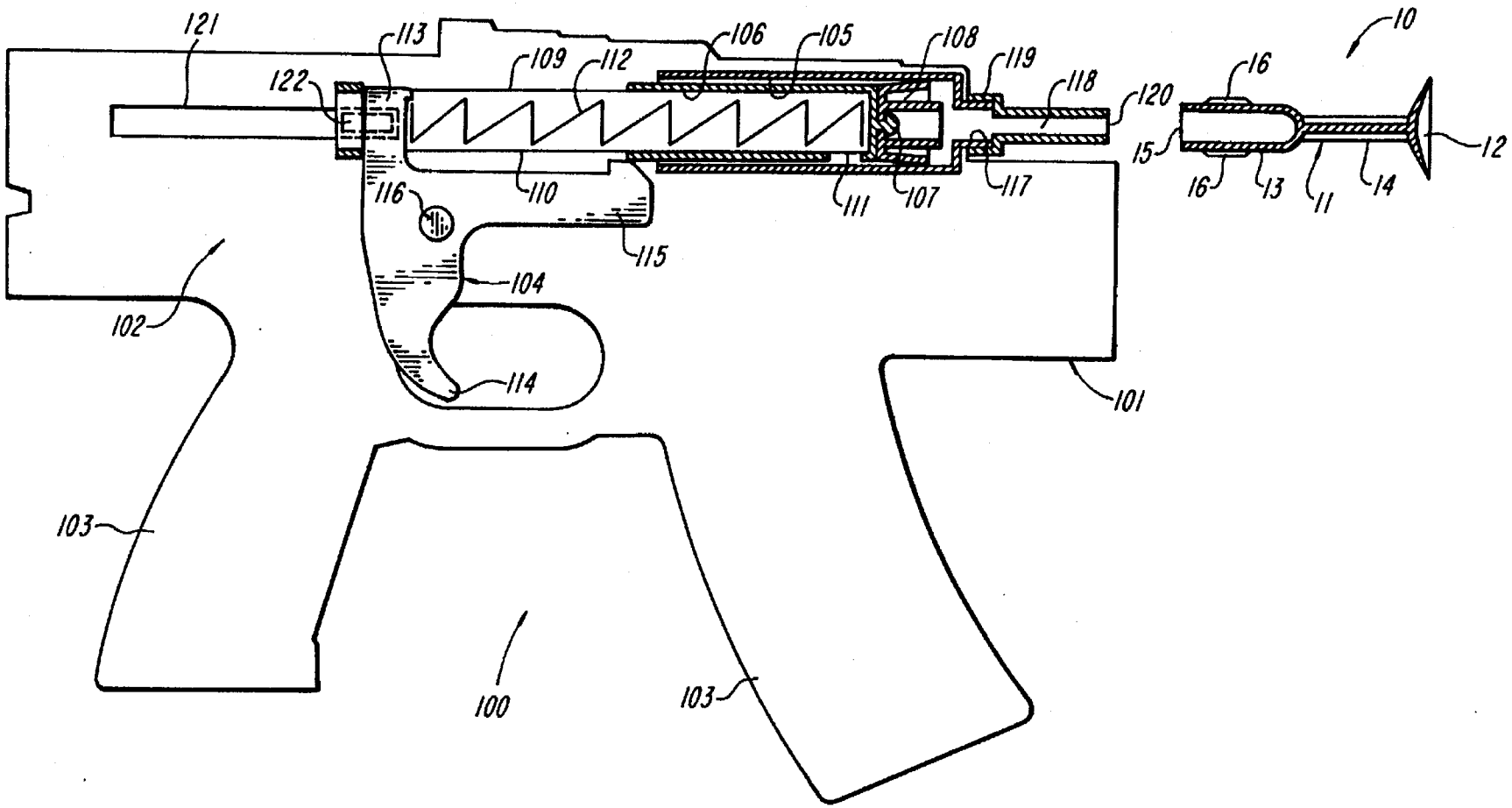
FIG. 2 is a cross-sectional side view corresponding to FIG. 1, showing the toy gun in a triggered condition with the toy dart being just launched.

Referring firstly to FIGS. 1 and 2 of the drawings, there is shown a toy dart 10 and a toy gun 100 embodying the invention, which toy dart 10 has a one-piece elongate body 11 of rubber or soft plastic material. The dart body 11 has a front end in the form of a suction cup 12, a rear end in the form of a sleeve (not necessarily circular in cross-section) or, in this particular embodiment, a tube 13 and a stem or shaft 14 having, for example, an X-shaped cross-section and extending between the suction cup 12 and the tube 13. The tube 13 has an open rear end 15 and, optionally, four external fins 16 for flight stabilising. The tube 13 has a cross-section which is larger and, preferably but not necessarily, a weight heavier than that of the shaft 14.

The toy gun 100 has a plastic body 101 comprising an upper part 102 and a pair of lower handgrips 103 including a trigger 104. In a horizontal direction, the upper part 102 houses a stationary cylinder 105 and also supports a plunger 106 for co-axial forward movement into and backward movement out of the cylinder 105 through an open rear end of the cylinder 105. The plunger 106 carries, at its front end by means of a mushroom-like central hook 107, a plastic cup-like piston 108 for sliding engagement with the inner surface of the cylinder 105 to form a pump-like air compression mechanism.

The plunger 106 is generally cylindrical and hollow and has a pair of top and bottom slots 109 and 110 extending along its rear half and a bottom aperture 111 near its front end. A helical coil spring 112 is accommodated co-axially inside the plunger 106. The trigger 104 has an upper end 113, a lower end to provide a pull 114 and an intermediate hook 115, and is pivotably positioned below the trigger 104 by means of aligned hinge pegs 116 on opposite sides. The upper end 113 extends through the bottom slot 110 into the plunger 106, between which end 113 and the front end of the plunger 106 the spring 112 co-acts to resiliently bias the plunger 106 forwards. The hook 115 extends forwards to reach just short of the rear end of the cylinder 105. Under the action of the spring 112, the trigger 104 has a tendency to turn anti-clockwise (as shown) to have its hook 115 urging upwards. The front end of the cylinder 105 is restricted into a nozzle 117.

The gun body upper part 102 has a pair of aligned slots 121 extending horizontally on opposite sides. The plunger 106 has, at its rear end and on opposite sides, a pair of aligned knobs 122 which are exposed through the respective side slots 121 to enable the plunger 106 to be pulled back manually against the action of the spring 112 inside. When the plunger 106 is pulled sufficiently backwards, it will be caught by the trigger hook 115 engaging the bottom aperture 111. In this condition as shown in FIG. 1, the spring 112 is charged and ready to propel the plunger 106 forwards upon pulling of the trigger 104.

The toy gun 100 further includes a sleeve-like or, in this particular embodiment, a tubular adaptor 118 which has a relatively wider and shorter open rear end 119 and a relatively narrower and longer open front end 120. The adaptor 118 has its rear end 119 releasably press-fit over the nozzle 117 to extend co-axially forwards from the nozzle 117. The tube 13 of the toy dart 10 has an inner diameter slightly smaller than the outer diameter of the adaptor front end 120 for co-axially fitting with almost its entire length over and around the adaptor front end 120 in a practically air-tight manner, whereby the dart 10 is mounted onto the adaptor 118.

The fitting of the hollow tubular end 13 of the toy dart 10 over the adaptor 118 minimises the risk of falling off of the overall dart 10 and the loss of energy on ejection. Also, a popping sound will be generated upon ejection of the toy dart 10, which adds more fun.

Upon pulling, the trigger 104 is turned slightly clockwise (as shown) to have its hook 115 disengaged from the bottom aperture 111 in order to release the plunger 106. The plunger 106 and hence the piston 108 will then be propelled forwards by the spring 112, thereby compressing the air inside the cylinder 105 and in turn ejecting the toy dart 10 forwards off the adaptor 118, as shown in FIG. 2.

As the tube 13 of the toy dart 10 is hollow and has a cross-section larger and, optionally, a weight heavier than that of the shaft 14, the resulting trailing weight and/or momentum of the dart 10 is distributed evenly around and at a distance off the (travelling) axis of the dart 10. This trailing weight and/or momentum has a balancing effect upon the whole dart 10 and enables the dart 10 to hit a target, such as a flat glass surface, relatively more stably and more readily for the suction cup 12 to stick onto the target surface, in comparison with a conventional suction-cup toy dart which has a plain shaft not centrally hollow at the tail. Also, the hollow end construction of the toy dart 10 reduces reaction force when the dart 10 hits a target, thereby ensuring a better suction effect.

The hollow end construction of the toy dart 10 allows the dart 10 to be carried in a gun holster provided with projections: or lugs for the dart 10 to be secured with its hollow end 13 fitted over, thereby reducing the risk of losing or falling off of the dart 10. Such projections or lugs may alternatively be provided on the toy gun 100 itself for holding the dart 10.

The toy gun 100 may be used in the condition with the adaptor 118 removed, revealing the nozzle 117 of the cylinder 105. In the absence of the optional fins 16, the tube 13 of the toy dart 10 has a smooth outer surface and, with an appropriate size, may be fitted/inserted backwards into the nozzle 117 and engaged therewith in a practically air-tight manner, for dart launching in the same manner as described above. With the adaptor 118 removed, the toy gun 100 may also be used to launch a conventional dart in the same manner. On the other hand, the toy dart 10 of the subject invention may also be launched by means of a conventional hollow-barrel toy gun.

Figure 3:
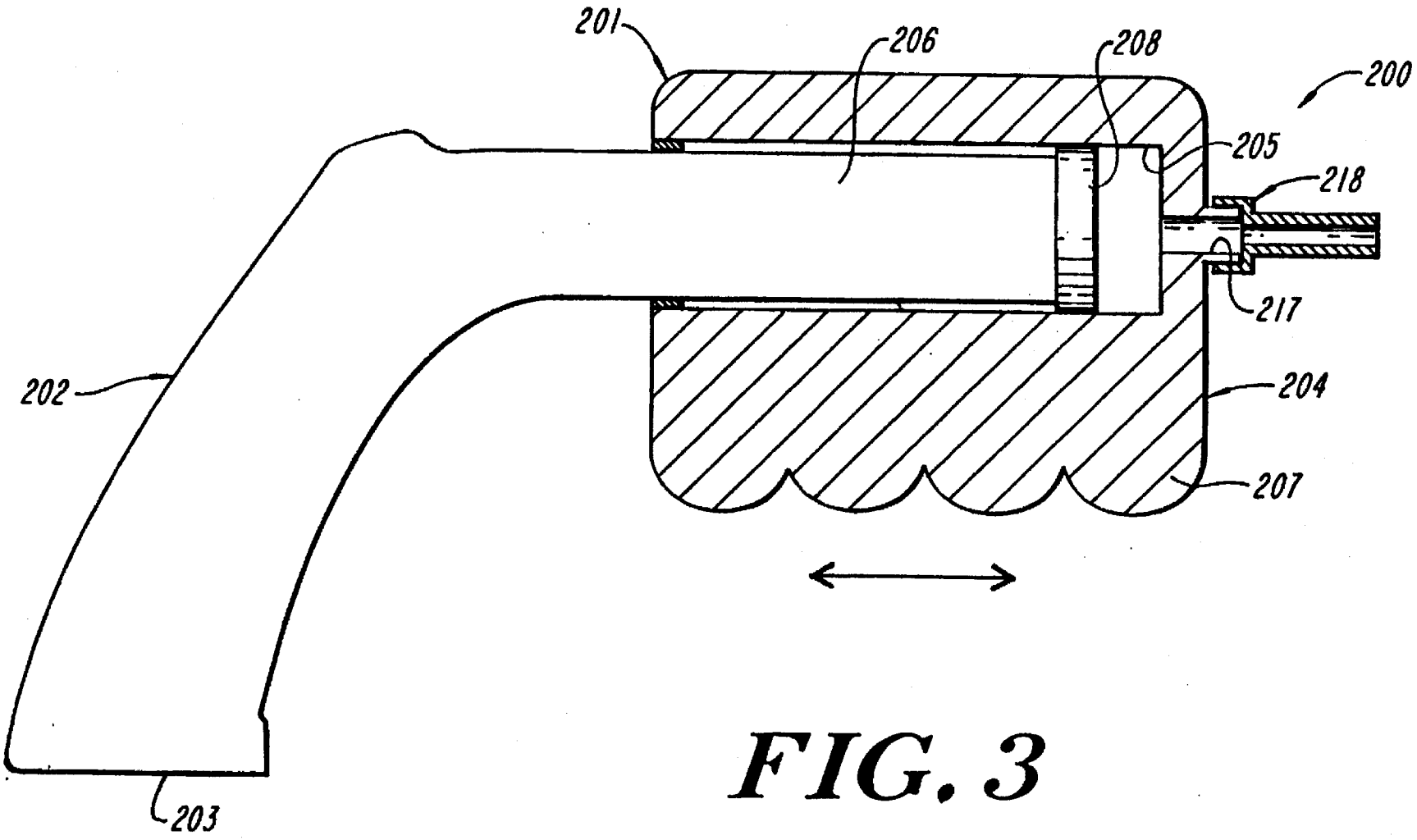
FIG. 3 is a cross-sectional side view of a different embodiment of a toy gun in accordance with the invention.

Referring now to FIG. 3 of the drawings, there is shown a different toy gun 200 embodying the invention, which gun 200 has a plastic body 201 formed by a rear part 202 and a front part 204. The rear body part 202 is in the form of a handgrip 203 having an upper end which extends forwards to form a horizontal bar 206. The bar 206 carries, at its extremity, a piston 208. The front body part 204 has a body 207 in which a cylindrical bore 205 is formed. The bore 205 extends horizontally and has open front and rear ends, which front end is restricted into a nozzle 217. The toy gun 200 includes a removable tubular adaptor 218 which has the same construction and use as the adaptor 118 described above.

The rear body part 202 supports the front body part 204 by having the bar 206 and piston 208 of the former inserted into the bore 205 of the latter, such that the front body part 204 is slidable back and forth on the rear body part 202. The piston 208 engages slidably with the inner surface of bore 205 to form a piston-and-cylinder mechanism which is not spring-loaded, for air compression.

In operation, the toy dart 10 is mounted on the adaptor 218 in the same manner as described above. With the rear body part 202 of the toy gun 200 gripped in place by one hand of a player, the front body part 204 is gripped by the other hand and slid quickly backwards. Relatively, the piston 208 moves forwards relative to the bore 205 and thus compresses the air inside to eject the dart 10 off.

The Invention has been given by way of example only, and various modifications of and/or alterations to the described embodiments may be made by persons skilled in the art without departing from the scope of the invention as specified in the appended claims.

What is claimed is:

1. In combination, a toy gun for launching a toy dart, and the toy dart;

said toy dart has an elongated body comprising a front end in the form of a suction cup, an intermediate portion, and a rear end which is hollow and has an enlarged cross-section; and said toy gun comprises a body and an air compression mechanism provided by a piston and a cylinder inside the body for launching said toy dart, said cylinder having a tubular opening end over and around which the hollow rear end of said toy dart is to be fitted for launching, wherein the tubular end is removable to reveal another opening of the cylinder for the insertion of the hollow end of a said toy dart and is provided by a tube having opposite ends of different diameters.

2. The combination toy gun and toy dart as claimed in claim 1, wherein the rear end has a weight relatively heavier than that of the intermediate portion.

3. The combination toy gun and toy dart as claimed in claim 1, wherein the rear end is substantially tubular.

4. The combination toy gun and toy dart as claimed in claim 1, wherein the intermediate portion has a substantially X-shaped cross-section.

5. The combination toy gun and toy dart as claimed in claim 1, said toy dart being integrally formed of rubber or soft plastic material.

* * * * *